United States Patent [19]

Rantanen

[11] Patent Number: 4,876,870

[45] Date of Patent: Oct. 31, 1989

[54] METHOD FOR MANUFACTURING TUBES

[75] Inventor: Mauri V. Rantanen, Espoo, Finland

[73] Assignee: Outokumpu Oy, Helsinki, Finland

[21] Appl. No.: 172,196

[22] Filed: Mar. 23, 1988

[30] Foreign Application Priority Data

Mar. 26, 1987 [FI] Finland ..... 871344

[51] Int. Cl.[4] ..... B21B 19/06

[52] U.S. Cl. ..... 72/78; 72/69; 72/364; 72/700; 29/527.7

[58] Field of Search ..... 72/78, 69, 200, 364, 72/95, 700, 68, 256, 100; 29/527.7, DIG. 45, DIG. 47

[56] References Cited

U.S. PATENT DOCUMENTS

| | | | |
|---|---|---|---|
| 3,496,755 | 2/1970 | Guernsey et al. | 72/700 |
| 3,613,425 | 10/1971 | Roberts | 72/202 |
| 3,673,836 | 7/1972 | Petersen et al. | 29/527.7 |
| 3,735,617 | 5/1973 | Bretschneider | 72/100 |
| 4,154,076 | 5/1979 | Tuschy et al. | 72/78 |
| 4,202,195 | 5/1980 | Tuschy et al. | 72/78 |
| 4,398,406 | 8/1983 | Fukuda et al. | 72/100 |
| 4,512,177 | 4/1985 | Hayashi et al. | 72/78 |

FOREIGN PATENT DOCUMENTS

| | | | |
|---|---|---|---|
| 934583 | 10/1973 | Canada | 72/78 |
| 2212402 | 9/1972 | Fed. Rep. of Germany | 72/364 |

OTHER PUBLICATIONS

The Extrusion of Metals by Pearson & Parkins, 2nd Ed. (1960) pp. 252–255.

Extrusion, Processes, Machinery, Tooling, by Laue, and Stenger; Copyright 1981 by Amer. Soc. For Metals; pp. 115–124.

*Primary Examiner*—Lowell A. Larson

*Attorney, Agent, or Firm*—Brooks Haidt Haffner & Delahunty

[57] ABSTRACT

The method of the invention relates to the manufacturing of tubes of a continuously cast or the like billet by means of cold working, wherein the temperature of the material rises to the recrystallization range due to the influence of the deformation resistance. The method is particularly related to the further working of billets made of non-ferrous metals such as copper, aluminum, nickel, zirconium and titanium, as well as of their alloys.

8 Claims, No Drawings

METHOD FOR MANUFACTURING TUBES

The method of the present invention relates to manufacturing tubes out of continuously cast or the like billets by means of cold working, so that the temperature of the material rises, owing to the influence of the deformation resistance, to the recrystallization range. Particularly the method is related to the further processing of billets made of non-ferrous metals such as copper, aluminium, nickel, zirconium and titanium as well as of alloys of each of these.

In the fabrication of semi-finished products of copper and copper alloys, the generally applied prior art procedure for further processing ingots from ingot casting, such as round billets and slabs, has been first hot working and then cold working. The hot-working stage has been for instance rolling, extrusion or piercing, and the cold-working stage has been for instance rolling, drawing or rolling in a Pilger mill. Thereafter each product is subjected to the special further treatment of the type of product in question.

In order to reduce the working stages in the manufacturing process, modern industry has to an increasing degree taken up continuous casting, where the purpose is to get the dimensions of the ingot as close as possible to the dimensions of the final product. In some connections this casting method is also called submerged die continuous casting. The crystal structure of a product created in continuous casting, such as that of a tube shell, is by nature coarse-grained and non-homogenous. This causes special problems in the further treatment of the material. The further treatment of a continuously cast billet with a small cross-sectional area, such as a strip, has often been cold working. However, the coarse and non-homogenous structure created in the casting may, especially in the cold working of a tube or a bar, result in a so-called orange peel surface on the material, which defect is still visible in the final product and hampers its acceptability in the final inspection. Another drawback of this structure is that when the cold working process is continued without intermediate annealing, as common in industry, the material is at an early stage already subject to cracks which lead to its breaking. This is particularly common in such working processes where the material has to bend under tension, for example if the bull block drawing is applied for tubes.

According to a common method for manufacturing tubes, the extruded tube shell is first cold rolled in a Pilger mill, whereafter a bull block drawing is carried out. However, the costs of Pilger rolling are high, and another drawback worth mentioning is that the possible eccentricity of the shell cannot be corrected by means of a Pilger mill.

As was already pointed out, hot working is the traditional solution in connection with ingot casting and partly also with continuous casting. By employing this method, the problems caused by the non-homogenous crystal structure after casting can also be solved, because metals and alloys are known to be recrystallized and consequently homogenized in the hot working process. But the application of hot working technique, in particular for the continuously cast billets of copper, aluminium and alloys thereof, which have small cross-sectional areas, is far too uneconomical.

SMS Schloemann-Siemag AC has developed a planetary rolling technique where three conical rolls are arranged at a angle of 120° to each other. The rolls rotate around their own axis and also around the central axis of the whole planetary system. The area reduction received in one single pass is high, even over 90%. Planetary rolling is often referred to by using the abbreviation PSW (Planetenschrägwalzwerk), and the said apparatus is protected by several patents.

So far planetary rolling has been applied to the rolling of steel. In the case of tubes, the preheated billets enter first for instance piercing mill and thereafter PSW mill. While rolling bars, the billets are first separately preheated; thus, in connection with rolling steel in planetary mills, the method of conventioned hot working is always applied.

A surprising discovery has recently revealed that in the working of non-ferrous metals, particularly copper, aluminium, nickel, zirconium and titanium, as well as alloys of each of these, a good final result—as regards the microstructure of the material—is achieved without separate pre-heating or without separate intermediate annealing, if in cold working the temperature of the material rises, due to a high area reduction and internal friction of the material in question, to the recrystallization range.

Cold working in general means a process wherein the material under treatment is brought without any preheating and where the temperature of the said material, during the working stage, remains below the recrystallization temperature. When cold working is referred to in connection with the present invention, we mean such working where the temperature at the beginning of the working process is ambient, but where, in the course of the working process, the temperature rises essentially above the normal cold working temperature, i.e. to the recrystallization range of the material.

In the performed experiments it has been proved that in the course of working, due to the deformation resistance created in the material by a large area reduction and internal friction, the temperature of the material rises to the range of 250°-750° C. A suitable, large area reduction is at least 70%, and advantageously about 90%. Experience has shown that a suitable recrystallization temperature for copper and copper alloys is within the range 250°-700° C., for aluminium and aluminium alloys in 250°-450° C., for nickel and nickel alloys in 650°-760° C., for zirconium and zirconium alloys in 700°-785° C., and for titanium and titanium alloys in 700°-750° C. The working temperature can be regulated to be suitable for each material in question by adjusting the cooling. The at least partly recrystallized structure allows further processing by cold working, for example bull block drawing of a tube, without any risk of cracking the material.

Moreover, it is advantageous for the method that the temperature rise in connection with the working is short in duration, so that the danger of excessive grain growth and excessive oxidation of the surfaces is avoided. The grain size of the material emerging from the working stage is small, about 0.005-0.050 mm.

In the cold working of a tube shell, planetary rolling has proved to be a suitable method for rising the temperature up to the recrystallization range. Inside the tube shell, which is advantageously for example 80/40 mm in diameter, a mandrel is placed by means of a mandrel carrier, and the tube shell is rolled to the dimensions of at least 55/40 mm and most advantageously to the dimensions of 45/40 mm, whereafter further drawings are carried out. Those acquainted with the art will understand that the abbreviated expression 80/40 mm, for example, means that the outside diameter of the tube is 80 mm and the inside diameter is 40 mm. Similar abbreviations are used throughout the text. The rolling of bars takes place in the same fashion as that of the tubes, but naturally without the mandrel. While manufacturing strips, it is possible to choose some other working method which brings about an area reduction high enough, such as forging.

If the increase in temperature, caused by the working process, is not sufficient for the recrystallization of the material, it can be enhanced by means of slight preheating of the material for instance by employing an induction coil, wherethrough the billet passes immediately before the working stage.

As is apparent from the above specification, a continuously cast material is a well suited feed material for PSW rolling, but apart from that, it can be for instance an extruded tube shell. Thus the expensive Pilger rolling can be replaced by the cheaper PSW rolling, and the additional advantages achieved are the better microstructure in the material and the possibility for decreasing the eccentricity of a tube shell during the process. The most advantageous alternative of the method of the present invention in the production of tubes and bars is the use of relatively cheap combination of continuous casting—PSW rolling equipment, which can be employed instead of the expensive technique of billet casting—extrusion (or piercing)—Pilger rolling.

The invention is further illustrated with the aid of the following examples.

EXAMPLE 1 (PRIOR ART)

A continuously cast tube shell, made of phosphorus deoxydized copper (Cu-DHP), was rolled in a Pilger mill. The initial size of the shell was 80/60 mm, and the grain size of the cast structure was 1–20 mm. The rolling succeeded, the size of the exit tube was 44/40 mm, and the cast structure had thus turned to work hardened structure. The hardness of the tube was within the range of 120–130 HV5. However, the tube rolled in the described fashion did not endure the bull-block drawing, only the straight bench draws succeeded. In order to draw the tube produced in this fashion with bull-blocks, an intermediate annealing was required. Accordingly it is maintained that the cast structure does not disappear in the rolling, because in this kind of rolling the temperature of the material remains low. Moreover, the quality of the surface was not satisfactory owing to the coarse cast structure.

EXAMPLE 2 (PRIOR ART)

A continuously cast tube shell, 80/40 mm, was drawn straight in a draw bench. The quality of the tube surface was poor, and the drawing could not be continued as bull-block draw without intermediate annealing, because the cast structure does not endure heavy reductions. The material of the shell was the same as in the previous example, and similarly the cast and work hardened structures, as well as the hardness of cold worked tube, remained within the same range as above.

EXAMPLE 3 (PRIOR ART)

A tube shell, 80/60 mm, grain size about 0.1 mm, which was extruded of a cast billet, size 280×660 mm and made of phosphorous deoxydized copper (Cu-DHP), was rolled in a Pilger mill to the dimension 44/40 mm. The hardness of a tube thus rolled was about 120–130 HV5, and the structure was the work hardened structure. Further working of the tube into the final dimensions is carried out as bull-block and bench draws without intermediate annealing. The final product can, if necessary, be soft-annealed.

EXAMPLE 4

A continuously cast tube shell made of phosphorous deoxydized copper (Cu-DHP), diameter 80/40 mm and structure normal cast structure (grain size 1–20 mm) was rolled in a PSW mill under conditions in accordance with the invention to the dimensions 46/40 mm. The rolling succeeded, and the thus rolled tube could also be drawn further with bull-blocks. Regarding the microstructure of the rolled tube it was observed that the grain size was small, 0.005–0.015 mm, which meant that recrystallization had taken place in the structure during the rolling. The hardness of the rolled tube was 75–80 HV5, which ment that soft-annealing was not necessary. The tube was subjected to six bull-block draws and obtained the dimensions 18/16.4 mm. After drawing the hardness of the tube was 132 HV5.

EXAMPLE 5

An extruded tube shell, 80/40 mm, material oxygen free copper Cu-OF, was rolled in a PSW mill under conditions in accordance with the invention to the dimensions 46/40 mm. The rolling succeeded, and the structure was recrystallized due to the influence of temperature increase in the working process. The grain size of the rolled tube was about 0.010 mm and hardness about 80 HV5.

I claim:

1. A method of manufacturing tubes of a non-ferrous metal, starting with a tube shell of a material consisting of copper, nickel, zirconium or titanium or their alloys at ambient temperature which tube shell has been made by continuous casting or extrusion, consisting of planetary cold rolling of the tube shell to cause an area reduction of at least 70 percent in one single pass, and because of said area reduction and resistance of the material to deformation, a temperature rise to the recrystallization temperature of the material, the grain size of the material remaining within the range of 0.005 to 0.050 mm.

2. The method of claim 1, wherein the area reduction is about 90 percent in one single pass.

3. The method of claim 1 wherein the temperature of the material rises to the range of 250° to 750° C.

4. The method of claim 3 wherein the material is copper or copper alloy and the temperature of the material rises to the range of 250° to 700° C.

5. The method of claim 3, wherein the material is nickel or nickel alloy and the temperature of the material rises to the range of 650° to 750° C.

6. The method of claim 3 wherein the material is zirconium or zirconium alloy and the temperature of the material rises to the range of 700° to 750° C.

7. The method of claim 3 wherein the material is titanium or tianium alloy and the temperature of the material rises to the range of 700° to 750° C.

8. The method of claim 1, including regulating the temperature of the material by adjusting cooling.

* * * * *